United States Patent [19]

Patel

[11] 4,031,278

[45] June 21, 1977

[54] HIGH HARDNESS FLAME SPRAY NICKEL-BASE ALLOY COATING MATERIAL

[75] Inventor: Mahesh S. Patel, Albertson, N.Y.

[73] Assignee: Eutectic Corporation, Flushing, N.Y.

[22] Filed: Aug. 18, 1975

[21] Appl. No.: 605,549

[52] U.S. Cl. ..... 427/423; 75/.5 R; 75/.5 BA

[51] Int. Cl.[2] ..... B05D 1/08

[58] Field of Search ..... 427/423; 75/.5 R, .5 BA

[56] References Cited

UNITED STATES PATENTS

| | | | |
|---|---|---|---|
| 2,786,779 | 3/1957 | Long et al. | 427/423 |
| 2,961,335 | 11/1960 | Shepard | 427/423 |
| 3,338,688 | 8/1967 | Longo | 427/423 |
| 3,428,442 | 2/1969 | Yurasko | 427/423 |
| 3,436,248 | 4/1969 | Dittrich et al. | 427/423 |
| 3,607,343 | 9/1971 | Longo | 427/423 |
| 3,617,358 | 11/1971 | Dittrich | 75/.5 B |
| 3,700,427 | 10/1972 | Hoppin et al. | 75/.5 R |
| 3,769,689 | 11/1973 | Little | 427/423 |

FOREIGN PATENTS OR APPLICATIONS

| | | | |
|---|---|---|---|
| 604,457 | 7/1948 | Canada | 427/423 |

OTHER PUBLICATIONS

Metco "R & D Powders for Flame Spraying Thermo Spray — Plasma Flame" Bulletin 10F 1/m 8–63 (1963).

*Primary Examiner*—Ronald H. Smith
*Assistant Examiner*—S. Silverberg
*Attorney, Agent, or Firm*—Hopgood, Calimafde, Kalil, Blaustein and Lieberman

[57] ABSTRACT

A metal spray powder blend is provided characterized by the property of forming a dense coating on a metal substrate comprising a self-fluxing nickel-base alloy powder having intimately associated with the surface thereof by blending an aluminum powder ranging in amount from about 0.5 to 5% by weight, the average size ratio of the nickel-base alloy powder to the aluminum powder being over 5:1, the aluminum powder having an average particle size of less than about 15 microns. A preferred method of spraying the powder is to gravity feed it into the flame of a metal spraying torch.

8 Claims, 9 Drawing Figures

HIGH HARDNESS FLAME SPRAY NICKEL-BASE ALLOY COATING MATERIAL

This invention relates to a metal spray powder blend and, in particular, to a self-fluxing nickel-base alloy powder blend and method for producing a surface coating of of optimum density and hardness on metal substrates.

STATE OF THE ART

It is known to hard face metal substrates, such as steel, with a self-fluxing nickel-base alloy coating. A composition and method for producing such coatings are disclosed in U.S. Pat. No. 3,488,205. An alloy composition disclosed as suitable for producing hard face coatings having adequate wear hardness is one comprising about 2.5 to 20% Cr, about 0.5 to 6% Si, 0.5 to 5% B, about 0.2 to 6% Fe, about 0.01 to 0.85% C and the balance essentially nickel.

However, in spraying an alloy of the foregoing type having a particle size ranging in average size from about −100 mesh to +325 mesh using a spray gun of the type disclosed and claimed in U.S. Pat. No. 3,620,454, it was difficult to obtain a deposit substantially free from porosity and having optimum hardness. Examination of coatings produced using the aforementioned type spray gun showed that the sprayed particles were not fully wetted and, therefore, did not produce dense coatings.

It is known to add a catalyst to a spray powder to improve the spray characteristics of the powder material being sprayed. In this connection, reference is made to U.S. Pat. No. 2,943,951 dated July 5, 1960, which is directed to a method of spraying certain types of refractory material onto substrate surfaces. In one embodiment, particles of silicon coated with a film of silicon dioxide are mixed with powdered aluminum which exhibits a strong heat of reaction with oxygen such that, when the powder mixture is sprayed, the surface film of silicon dioxide is reduced by the aluminum such that sintering together of the silicon particles is obtained on the surface sprayed.

In Example 1 of the patent, a mixture of 92% by weight of $MoSi_2$ particles having a thin film of $SiO_2$, 3% cobalt oxide and 5% by weight of aluminum powder is disclosed for spraying dispersed in polyethylene comprising 15% by weight of the total powder mixture. The particle size of the $MoSi_2$ powder ranges from 5 to 10 microns and the particle size of the aluminum power is about 40 microns, the particle size of the aluminum being much larger than the host powder.

Attempts were made to use a mixture of aluminum powder of approximately 30 microns with a nickel-base alloy containing boron and silicon of the type disclosed hereinbefore of particle size between −140 mesh and +325 mesh (approximately 75 microns average size) in a metal spray system, but the deposit obtained was not dense and the hardness varied due to the porosity of the coating, the hardness being low and ranging from about 25 to 27 Rockwell C.

It would be desirable to provide a powder blend capable of forming nickel-base alloy coatings characterized by optimum hardness and high density.

OBJECTS OF THE INVENTION

It is thus an object of the invention to provide an improved powder blend comprising a nickel-base alloy powder.

Another object is to provide a method for producing a hard facing nickel-base alloy coating on metal substrates characterized by optimum density and hardness.

These and other objects will more clearly appear when taken in conjunction with the following disclosure and the accompanying drawings, wherein.

STATEMENT OF THE INVENTION

Figure 1:
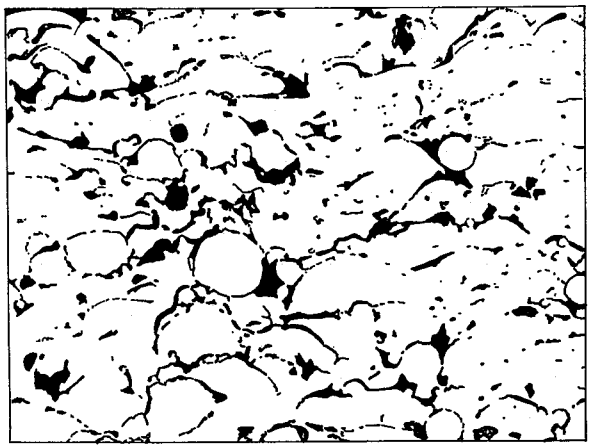
FIGS. 1 and 2 are representations of photomicrographs taken at 100 times magnification of a metal spray coating produced in accordance with and outside the invention, respectively.

I have found that I can produce highly dense coatings of a self-fluxing nickel-base alloy exhibiting optimum hardness provided that a small but effective amount of aluminum powder is blended with the nickel-base alloy powder prior to the spraying thereof on a metal substrate, such as steel.

I have found that, in order to achieve the results of the invention, it is important that the aluminum powder blended with the nickel-base alloy powder have a certain size relationship relative to the nickel-base alloy powder, the ratio of the average size of the nickel-base alloy powder to the aluminum alloy powder being over 5:1 and preferably ranging from about 7:1 to 35:1 for aluminum powder having an average particle size of less than 15 microns and, preferably, less than about 13 or 10 microns.

The nickel-base alloy powder employed as the self-fluxing alloy contains about 2.5 to 20% Cr, 0.5 to 6% Si, 0.5 to 5% B, up to about 1% C, up to about 10% Fe and the balance essentially nickel, the average particle size of the powder falling within the range of about −100 to +325 mesh (U.S. Standard), or minus 150 microns to plus 44 mesh powder. A preferred range is −140 mesh to +325 mesh (e.g. minus 105 microns to plus 44 microns). Atomized nickel-base alloy powder is preferred as it flows easily by gravity to the flame of the spray torch of the type illustrated in FIG. 6 of the drawing. Preferably, the nickel-base alloy contains about 10 to 20% Cr, about 2 to 6% Si, about 1.5 to 5% B, up to about 1% C, up to about 10% Fe and the balance essentially Ni.

It is important in producing the blend that the small but effective amount of aluminum be intimately associated with the surface of the nickel-base alloy powder. The amount of aluminum added may range from about 0.5 to 5% by weight of the total mixture and, preferably, from about 1 to 4% by weight. The foregoing corresponds to approximately 1 to 15% by volume and 3 to 11% by volume, respectively.

The aluminum powder employed over the foregoing range of composition is advantageous in that it supplements the heat of the nickel-base alloy particles being sprayed with additional heat by virtue of the heat of oxidation of aluminum which is high. Thus, sufficient superheat is applied to the particles to produce highly dense coatings.

Aluminum provides a high heat of oxidation when it reacts with oxygen at elevated temperature. Substantially full use of the added heat is obtained when the aluminum blended with the atomized nickel-base alloy is intimately associated with the surface of the particles. It is believed that the mechanical mixing of the powder at the correct particle size ratios causes the fine aluminum powder to become associated with the surface of the nickel-base powder by electrostatic forces. Thus, the fine aluminum powder follows the nickel-base alloy powder during spraying with minimum segregation and oxidizes exothermically to provide the additional heat to superheat the nickel-base powder.

Figure 5:
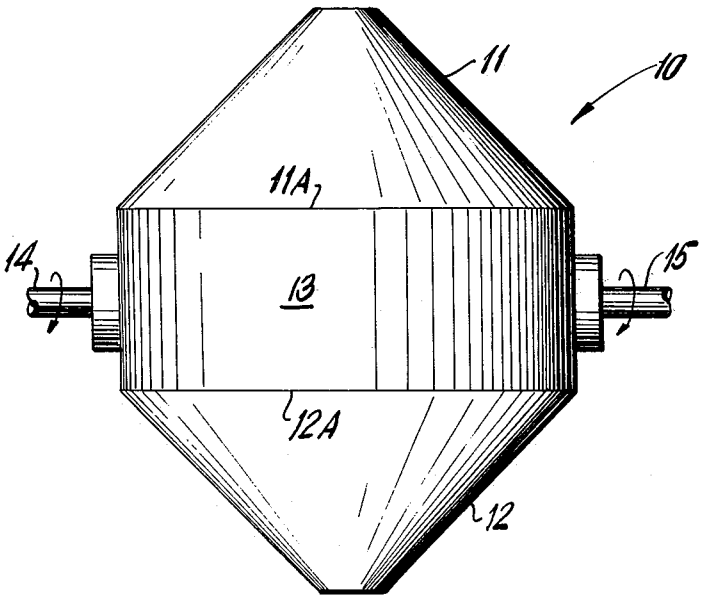
FIG. 5 shows a mixer which may be employed to blend the powders together.

One method of obtaining the desired blend is to mix the powders in a tumbling mill of the type illustrated by the schematic of FIG. 5 comprising a double cone construction as shown referred to in the trade by the designation ROTA-CONE and manufactured by Abbe Engineering Company of Brooklyn, N.Y. The mixer 10 comprises a pair of hollow cones 11, 12 joined together at the bases 11A, 12A by a hollow cylindrical portion 13. The mixer has stub shafts 14, 15 extending horizontally from the sides thereof which are rotatably supported by driving means not shown. This type of mixer is advantageous in that it assures intimate blending of the powders.

Figure 7:
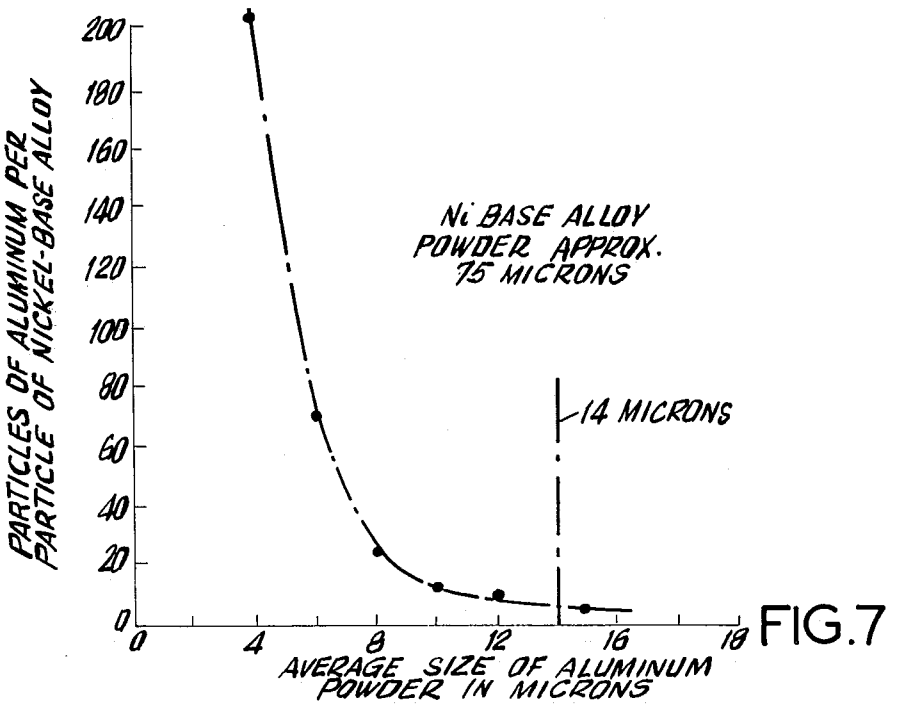
FIG. 7 is a curve showing the relationship between the number of particles of aluminum per particle of a nickel-base alloy plotted against the average size of aluminum powder in the blend.
Figure 9:
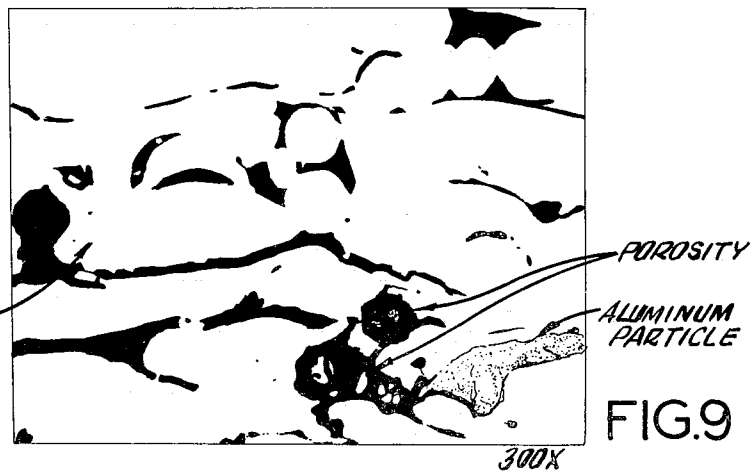
FIGS. 8 and 9 are representations of photomicrographs at 100 and 300 times magnification, respectively, of a metal spray coating obtained with a powder mixture containing relatively coarse aluminum powder.

As stated hereinbefore, in order to obtain the desired blend, it is important that the ratio of the average particle size of the nickel-base powder to the average particle size of the aluminum powder be over 5:1 and, preferably range from about 7:1 to 35:1. It is also preferred that the powder mix being blended contain an average of at least 5 particles of aluminum per particle of nickel-base alloy, for an average particle size of aluminum of less than about 15 microns. A preferred relationship is that shown in FIG. 7. For example, at an average particle size of about 10 microns for aluminum and about 75 microns for the nickel-base alloy, there are an average of between 12 to 13 particles of aluminum per particle of nickel-base alloy. At an average particle size of about 14 microns for aluminum, the average number of particles of aluminum per particle of the nickel-base alloy powder is over 5.

I have found that, when an attempt is made to blend an aluminum powder of approximately 30 microns average particle size with the nickel-base alloy at approximately 75 micron average particle size (size ratio of nickel-base alloy powder to aluminum powder of about 2.50:1), the improved results of the invention are not obtained.

DETAILS OF THE INVENTION

As stated above, the nickel powder employed is preferably in the atomized form. A particular composition is one containing by weight 11% Cr, 3% Si, 2% B, 3% Fe and the balance essentially nickel, the powder generally being rated as coarse powder and preferably comprising −140 +325 mesh with a maximum of about 15% passing through 325 mesh and a maximum of about 5% at +140 mesh.

Figure 6:
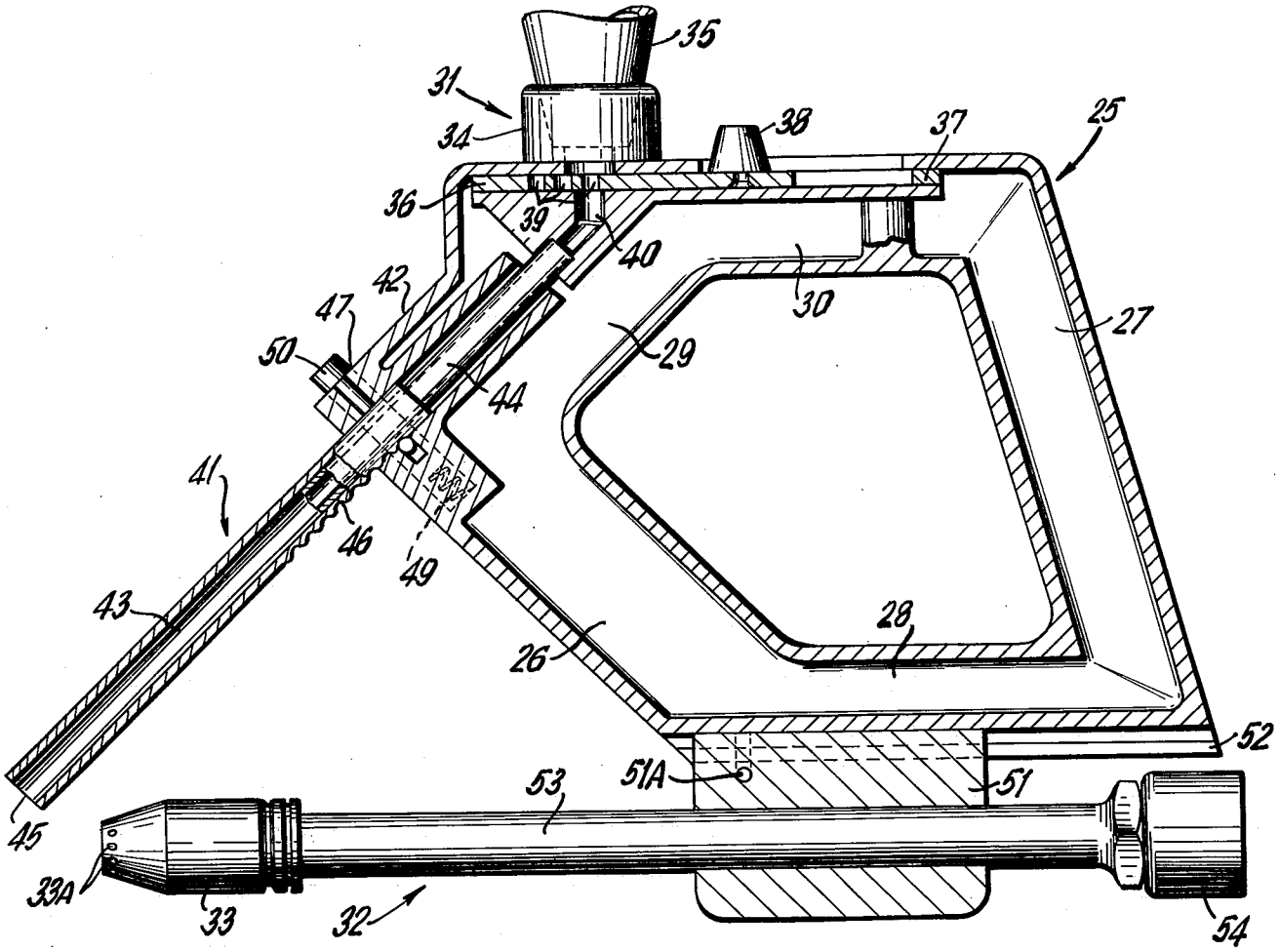
FIG. 6 depicts one embodiment of a metal spray torch for spraying the improved coating material of the invention.

The foregoing powder is preferably sprayed with a gravity feed torch of the type illustrated in FIG. 6 of the drawing. In using the foregoing spray torch, the following powder composition was prepared.

About 99% by weight of atomized nickel-base powder of about −140 mesh +325 mesh averaging about 75 microns in size is mixed with 1% by weight of atomized aluminum powder of approximately 10 microns in size, the nickel-base alloy assaying about 11% Cr, 2% B, 3% Si, 3% Fe and the balance Ni. The mixing is carried out in the ROTO-CONE blender shown schematically in FIG. 5. For a 100 to 1000 lb. batch, a mixing time of about 20 to 60 minutes is employed. A typical charge is one comprising 9 lbs. of aluminum and 591 lbs. of alloy powder. This corresponds to about 1.5% Al. Excess Al is employed to compensate for losses due to sticking in the mill. As will be noted, the ratio of average particle size of the nickel-base alloy (75 microns) to the average size of aluminum (10 microns) is b 7.5:1. At this size ratio, there are about 12 to 13 particles of aluminum to each particle of nickel-base alloy. This is advantageous as it enables uniform blending of the powder and produces a spray powder in which the aluminum is intimately associated with the surfaces of the nickel-base powder. By having a high halo density of small particles of aluminum surrounding each particle of nickel-base alloy during spraying, the additional heat due to oxidation of aluminum is assured for each particle of nickel-base alloy. This will be apparent from the photomicrographs herein.

Using the foregoing blend, a 0.06 inch thick sprayed coating is obtained on a 1020 steel plate. A control spray is provided of the nickel-base powder without aluminum added.

The flame spray torch 25 shown is adapted for gravity feed of the foregoing alloy powder mix directly to the flame issuing from the nozzle. The torch has a housing in the shape of a five-sided polygon with one leg of the polygon arranged as a handle portion 27, another leg as a base portion 28, a further leg as a feed portion 29, and another leg of the polygon as the top portion of the torch. The housing 26 has coupled to it a powder feed assembly 31 and a flame assembly 32 to which is coupled nozzle 33 having a plurality of gas-conducting orifices 32A emerging from the conical surface adjacent the end of the tip.

The top portion 30 is provided with a fitting 34 adapted to receive a receptacle 35 for holding the alloy powder, a metering device being employed to control powder feed comprising a feed actuator plate 36 slidably mounted in a slot 37 located in the housing top port 30 below fitting 34. Feed plate 36 is provided with a knob 38 which protrudes upwardly above the housing and permits the sliding of feed plate 36 reciprocally toward and away from housing feed portion 29.

It is known that metal powders used in metal spray torches vary in composition and in particle size from approximately 25 mesh to finer sizes and that such powders have different flow rates. Optimum powder spray results for particular applications are obtained within specific powder spray densities which are determined by powder flow rates. Best results are obtained by direct gravity flow which is determined by experimentation for each powder. Thus, it has been found that powder flow and spray rates for powder flowing by gravity unhindered through circular orifices in sizes ranging from 0.075 to 0.120 inch for different alloy powders can be maintained substantially constant over a mesh size range of −50 to +400 mesh.

In achieving the desired flow rate, feed plate 36 is selectively aligned with powder flow orifice 39 to control variably the flow rate of the powder from receptacle 35 through flow orifice 39 through conduit 40 and through variable spray control assembly 41. Assembly 41 has a housing 42 which holds a powder feed tube 43 and having a central core hollow cylinder 44 slidably and telescopically fitted within feed tube 43 and communicating directly with powder flow conduit 40 to deliver powder directly by gravity to feed tube 43 through discharge end 45. A portion of the outer surface of feed tube 43 is provided with indexing means or grooves 46 which through latching assembly 47 enables the setting of powder feed tube 43 in order to locate discharge end 45 at the correct distance from the flame end of nozzle 33. The latching assembly comprises a holding pin 48 that is normally urged toward one of the indexing grooves 46 by spring 49, the holding pin 48 being actuated by rod 50 in making the setting. Thus, by depressing rod 50, the pin is moved out of contact with one of the indexing grooves and tube 43 set according to the desired position. This position can be set at the factory and may not require further setting later.

The flame assembly 32 is supported by sliding element 51 which can be lockingly moved along a track 52 located at the bottom leg of housing 26, a locking pin 51A being provided as shown. Gas flow tube 53 is fixedly held by sliding element 51 and may be factory set, one end of the tube having a connector 54 for attaching to a source of oxygen and acetylene.

In spraying the alloy powder, a standard oxyacetylene flame was employed as normally used for flame spraying.

The alloy powder without the aluminum blend was sprayed on the 1020 steel plate to a thickness of about 0.06 inch. A similar coating was sprayed using the blended powder.

The results obtained showed a marked improvement in the quality and properly of the coating obtained with the invention as compared to the coating obtained without the aluminum blend. This will be clearly apparent from FIGS. 1 to 4 which are representations of photomicrographs taken at 100 and 300 times magnification.

Figure 3:
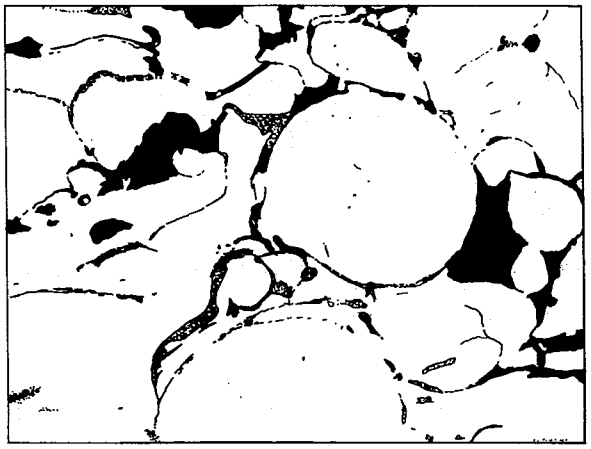
FIGS. 3 and 4 are representations of photomicrographs similar to FIGS. 1 and 2 but at 300 times magnification.

Thus, referring to FIG. 1 (100 times magnification) which is the nickel-base alloy coating without aluminum, a very porous structure is shown due to unmelted particles and poor fusion in the coating. The average spray hardness ranged from 22 to 25 Rockwell C. The same coating is shown in FIG. 3 at 300 times magnification, the sprayed particles substantially retaining their indentity.

Figure 2:
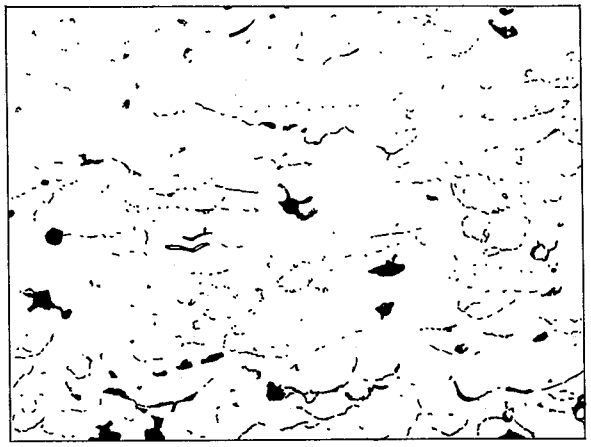
Figure 4:
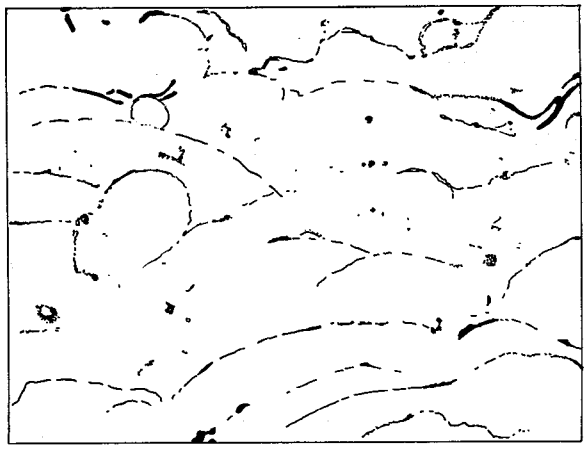

On the other hand, when the nickel-base alloy-aluminum blend was sprayed, the amount of porosity dramatically decreased as illustrated in FIG. 2 (100 times magnification) and shown more clearly in FIG. 4 (300 times magnification). The hardness of the coating was much harder and ranged from about 35 to 39 Rockwell C.

Assay of the coating produced by the invention showed that practically no aluminum was deposited which indicated that the aluminum is substantially all oxidized during spraying, giving up its heat to the alloy being sprayed. Small traces of aluminum oxide were noted in the coating.

A topological examination revealed that the surface of the coating produced with the invention was uniform, thus indicating substantially complete melting of the alloy; whereas, the coating outside the invention showed only partial fusing of the nickel-base alloy particles.

In a test in which 2% aluminum was blended with the Ni-Cr-Si-B alloy, the coating exhibited a hardness of about 45 $R_C$. The microstructure of the coating was substantially free of pores.

The importance of controlling the particle size will be apparent from the following test.

Figure 8:
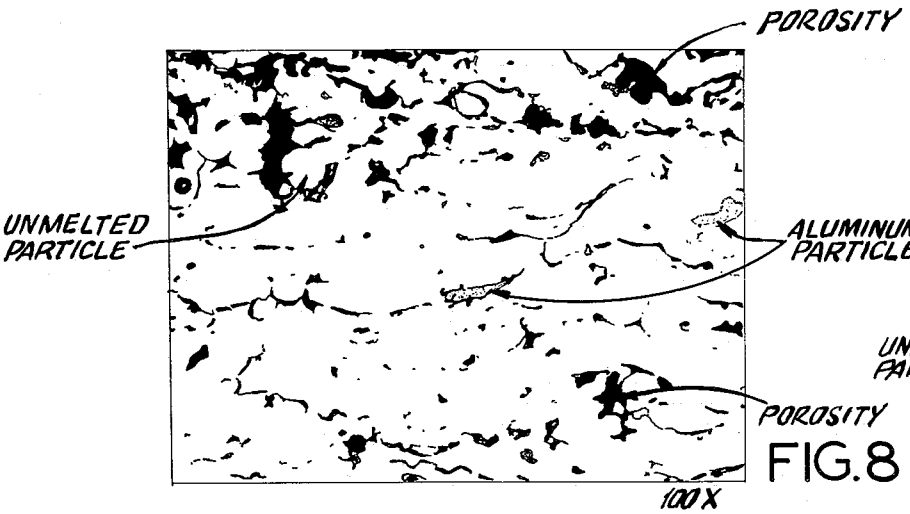

An atomized aluminum powder of about 1% by weight having an average particle size of 30 microns ($-37\mu + 20\mu$) was blended with 99% atomized nickel-base alloy powder of about 75 microns average size (11% Cr, 3% Si, 2% B, 3% Fe and the balance essentially nickel) for 30 minutes. The blended powder was sprayed on a 1020 steel plate using the torch of FIG. 6. A porous coating of about 0.06 to 0.08 inch in thickness was obtained as will be noted by referring to FIGS. 8 (100×) and 9 (300×). It will also be noted that some of the aluminum did not oxidize and occluded as particles with the nickel-base alloy coating. Some of the nickel-base alloy powder did not melt thus indicating that the coarse aluminum powder does not provide sufficient heat of oxidation to melt the alloy particle. In addition, the ratio of the nickel-base alloy particle to aluminum is too low, that is, 75:30 or 2.5:1.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A metal spray powder blend characterized by the property of forming a dense coating on a metal substrate consisting of, particles of a nickel-base alloy powder intimately mixed with aluminum powder, a major portion of said nickel-base alloy powder having an average particle size falling within the range of about −100 mesh to +325 mesh, said nickel-base alloy powder containing by weight about 2.5 to 20% Cr, 0.5 to 6% Si, 0.5 to 5% B, up to about 1% C, up to about 10% Fe and the balance essentially nickel, said aluminum mixed with said nickel-base alloy powder having a particle size less than 15 microns and ranging by weight from about 0.5 to 5% of the total mixture and being in intimate association with the surface of the particles of said nickel-base alloy, the ratio of average particle size of said nickel-base powder to the average particle size of said aluminum powder being over 5:1.

2. The metal powder blend of claim 1, wherein the average particle size ratio of said powders ranges from about 7:1 to 35:1.

3. The metal powder blend of claim 2, wherein the average particle size of aluminum powder is less than about 13 microns.

4. The metal powder blend of claim 2, wherein the nickel-base alloy ranges in composition from about 10 to 20% Cr, about 2 to 6% Si, about 1.5 to 5% B, up to 1% C, up to 10% Fe and the balance essentially nickel.

5. A method of flame spraying a self-fluxing nickel-base alloy powder on a metal substrate as a high density coating with optimum hardness which comprises, providing a mixture of particles consisting of said nickel-base alloy powder intimately mixed with about 0.5 to 5% by weight of aluminum powder based on the total mixture, said aluminum powder being less than 15 microns in average size, the major portion of said nickel-base alloy having an average particle size falling within the range of about −100 mesh to +325 mesh, said nickel-base alloy containing by weight about 2.5 to 20% Cr, about 0.5 to 6% Si, about 0.5 to 5% B, up to about 1% C, up to about 10% Fe and the balance essentially nickel, the ratio of average particle size of said nickel-base alloy powder to said aluminum powder being over 5:1, the aluminum powder being intimately associated with the surface of the particles of said nickel-base alloy powder, and then flame spraying said blended powder into a metal substrate, whereby a highly dense nickel-base alloy coating is obtained exhibiting optimum hardness.

6. The method of claim 5, wherein the ratio of average size of said nickel-base alloy powder to said aluminum powder ranges from about 7:1 to 35:1.

7. The method of claim 6, wherein the average size of said aluminum powder is less than about 13 microns.

8. The method of claim 6, wherein the nickel-base alloy powder ranges in composition from about 10 to 20% Cr, about 2 to 6% Si, about 1.5 to 5% B, up to 1% C, up to 10% Fe and the balance essentially nickel.

* * * * *